US005271256A

United States Patent [19]

Hedrick et al.

[11] Patent Number: 5,271,256

[45] Date of Patent: Dec. 21, 1993

[54] TOOLING MODULE FOR STAMPING AND FORMING MACHINE

[75] Inventors: David B. Hedrick, Stevens; Johannes C. W. Bakermans, Harrisburg; Robert B. Gingrich, Elizabethtown, all of Pa.

[73] Assignee: The Whitaker Corporation, Wilmington, Del.

[21] Appl. No.: 936,699

[22] Filed: Aug. 27, 1992

[51] Int. Cl.[5] ..... B21D 5/04

[52] U.S. Cl. ..... 72/307; 72/315; 72/383

[58] Field of Search ..... 72/312–315, 72/323, 387, 388, 397, 394, 396, 452, 383, 381

[56] References Cited

U.S. PATENT DOCUMENTS

| | | | |
|---|---|---|---|
| 3,135,310 | 6/1964 | Stoltz | 72/397 |
| 4,497,196 | 2/1985 | Bakermans et al. | 72/405 |
| 4,520,646 | 6/1985 | Pauzin | 72/313 |
| 4,819,476 | 4/1989 | Bakermans et al. | 72/456 |
| 5,062,289 | 11/1991 | Bakermans | 72/383 |

FOREIGN PATENT DOCUMENTS

| | | | |
|---|---|---|---|
| 151225 | 7/1987 | Japan | 72/313 |
| 199231 | 9/1987 | Japan | 72/452 |

*Primary Examiner*—Daniel C. Crane

[57] ABSTRACT

A tooling module for use in a stamping and forming machine comprises a tooling portion and an actuator portion. The actuator portion is fixed to a reciprocable ram and the tooling portion is slidably carried by the actuator portion. The tooling portion is normally spaced from to the actuator portion and is movable to an adjacent position. The tooling portion has forming tooling thereon for performing a bending or other operation on strip material. The actuator portion has an actuator such as a cam for moving the forming tooling when the module is moved by the ram against the strip on which forming operations are being carried out.

19 Claims, 8 Drawing Sheets

TOOLING MODULE FOR STAMPING AND FORMING MACHINE

FIELD OF THE INVENTION

This invention relates to tooling modules which are used in stamping and forming machines of the type having opposed ram assemblies that move towards and away from each other for performing stamping and forming operations on strip material which is between the ram assemblies.

CROSS REFERENCES TO RELATED U.S. PATENTS

U.S. Pat. Nos. 5,062,289; 4,497,196; and 4,819,476 are incorporated by reference into this application.

BACKGROUND OF THE INVENTION

U.S. Pat. No. 5,062,289 describes a tooling module intended for use in a stamping and forming machine as the type described in U.S. Pat. Nos. 4,497,196 and 4,819,476. The stamping and forming module describe in U.S. Pat. No. 5,062,289 is capable of carrying out a variety of forming operations on blanks which are integral with a continuous strip that is fed through the machine in which the modules are mounted. The specific embodiment described in the above identified patent is capable of forming 180 degree bends in the opposite ends of a blank at a single forming station rather than in several stations as is common practice.

The present invention is directed to the achievement of an alternative module which is capable of carrying out operations as described in U.S. Pat. No. 5,062,289 and is capable of carrying out other operations on flat blanks or partially formed blanks. Specifically, the present invention is directed to the achievement of a relatively simplified module containing fewer parts of which is capable of a wide variety of forming operations.

THE INVENTION

The invention comprises a machine for performing forming operations on strip material, the machine having first and second axially aligned ram assemblies which are movable towards and away from each other along paths of reciprocation between retracted positions and forward positions. Strip feeding means are provided for feeding strip material along a strip feed path which extends between the ram assemblies, the plane of the strip being perpendicular to the paths of reciprocation. The ram assemblies have leading ends which move against the strip when the ram assemblies move to their forward positions. The machine is characterized in that at least one of the ram assemblies has a forming tooling module on its leading end. The module has a tooling portion and an actuator portion, the actuator portion being fixed to the one ram assembly and the tooling portion being slidably carried by the actuator portion and being normally in-spaced relation to the actuator portion. The tooling portion is movable towards the actuator portion to an adjacent position in which it is adjacent to the actuator portion. The tooling portion has forming tooling thereon for performing a forming operation on the strip, the tooling portion being moved transversely of the paths of reciprocation when the forming operation is carried out. The actuator portion has actuator means thereon for moving the forming tooling when the forming tooling portion is moved to its adjacent position whereby upon movement of the ram assemblies from their retracted positions to their forward positions, the leading ends of the ram assemblies move against the strip and the tooling portion is moved to its adjacent position with respect to the actuator portion so that the tooling is moved and the forming operations are carried out.

THE DRAWING FIGURES

THE DISCLOSED EMBODIMENT

Figure 1:
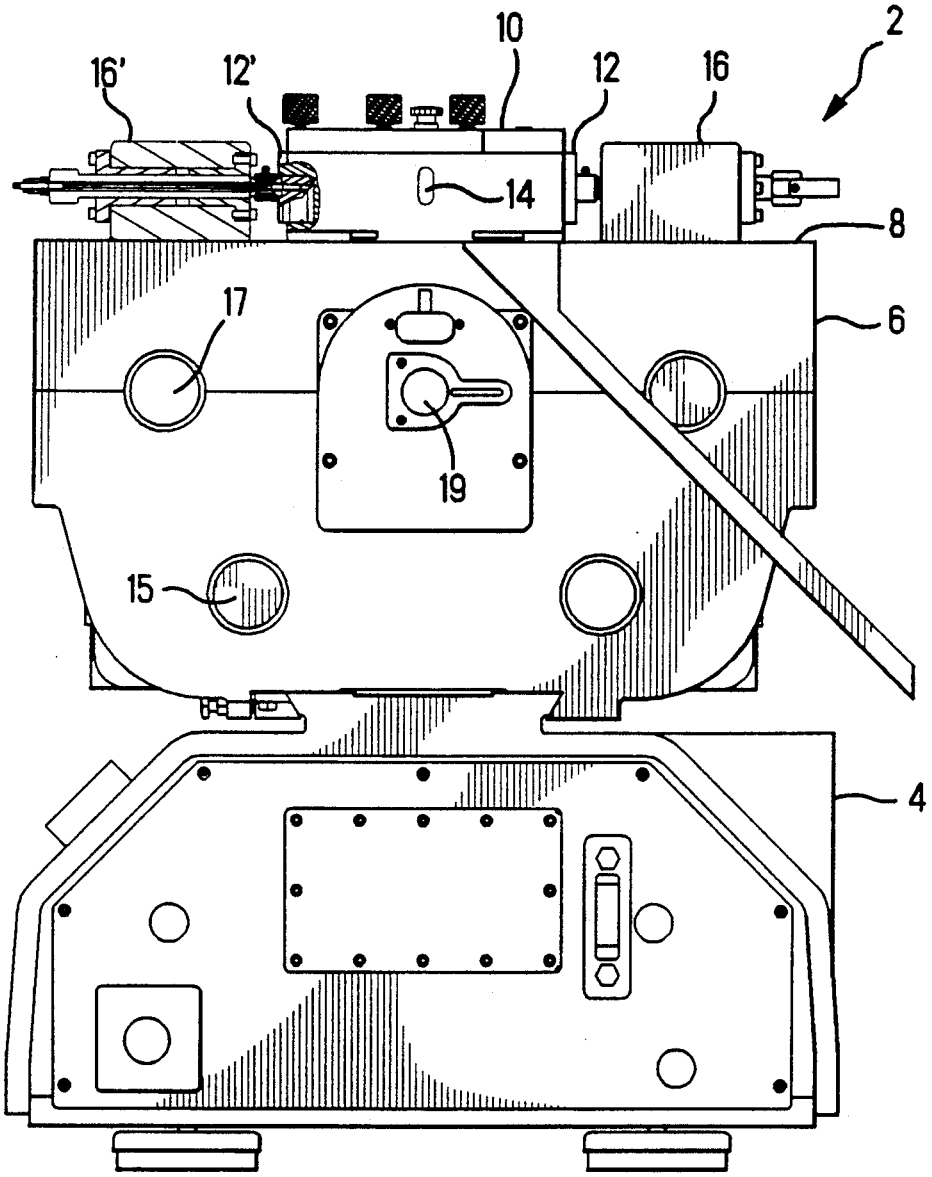
FIG. 1 is an end view of a stamping and forming machine.

A stamping and forming machine 2 of the type described in U.S. Pat. No. 4,497,196 comprises a base 4 having one or more machine modules 6 mounted thereon. The machine module 6 has an upper surface 8 which supports a ram housing 10 which contains opposed ram assemblies 12, 12'. Strip material 18 is fed through the housing by means of a strip feeding mechanism through slots 14 in the side walls of the housing 10. The ram assemblies 12, 12' are reciprocated towards and away from each other by levers having upper ends 16, 16' which oscillate along arcuate paths. Each lever is pivoted at its lower end 15 and is coupled by an eccentric 17 to a power shaft 19.

Figure 13:
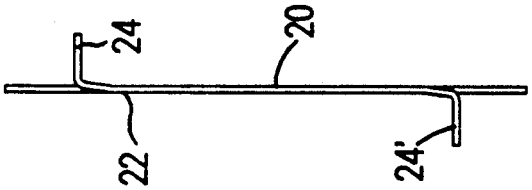
Figure 12:
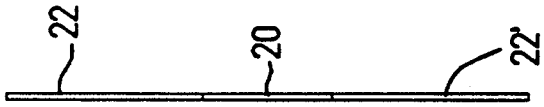
FIG. 12 is a view looking in the direction of the arrows 12—12 of FIG. 11.
Figure 11:
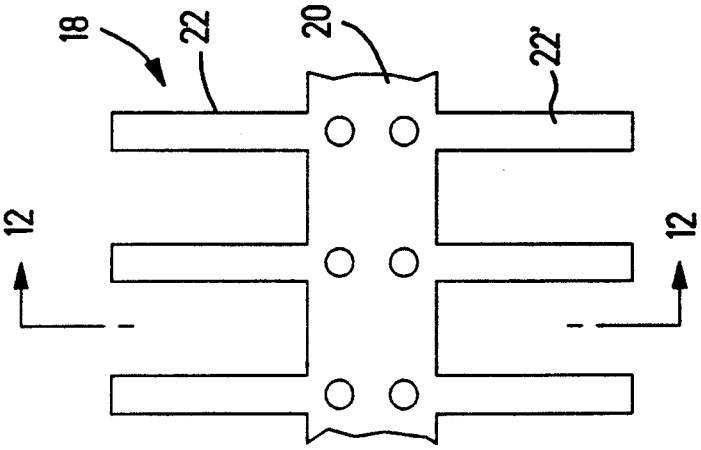
FIG. 11 is a plan view of a short section of strip which has been blanked.

The embodiment of the invention described below carries out bending operations on strip material 18, FIG. 11, which has a central carrier strip 20 and blanks 22, 22' extending from its side edges. As shown in FIG. 13, the blanks are first bent so that the end portions 24, 24' extend at an angle of 90 degrees from the central section 20. Thereafter, the end portions are bent through a further angle of 90 degrees as shown at 25, 25', FIG. 14, so that end portions 26, 26' are parallel to, and spaced from, the plane of the Central portion 20 of each blank. The strip 18 shown in FIG. 11 is shown for purposes of illustration only and in fact, much more complex operations are carried out by the machine as described fully in U.S. Pat. No. 5,062,289. Also, the machine described below performs operations on six blanks simultaneously and FIGS. 2–10 illustrate only the operation which is performed on two of the six blanks which are formed during each operating cycle of the machine.

Figure 6:
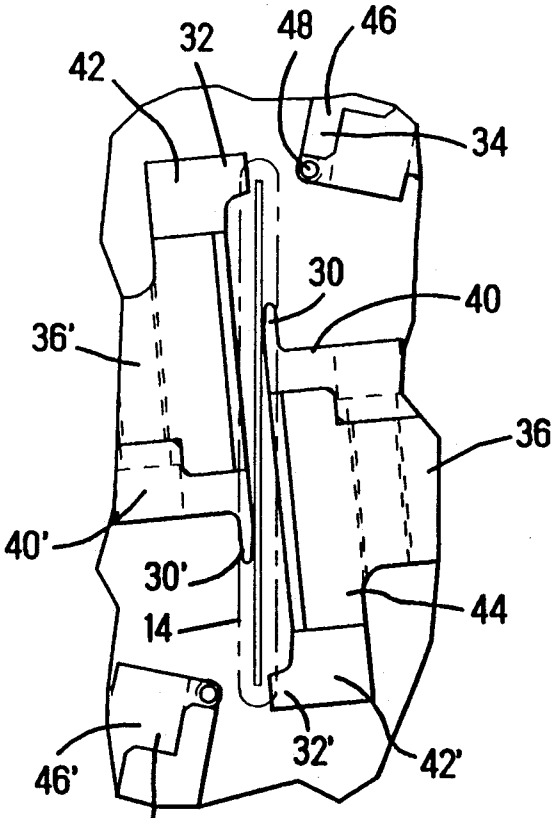
FIG. 6 is a fragmentary view on a greatly enlarged scale showing portions of the forming tooling.
Figure 14:
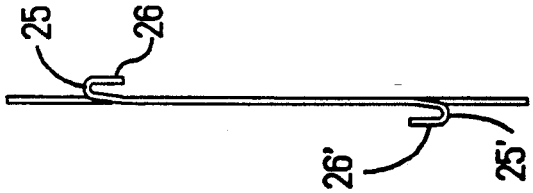
FIGS. 13 and 14 are views of illustrating the successive stages in the forming operation which is carried out on the strip of FIG. 11.

The forming or bending operations shown in FIGS. 13 and 14 are carried out by first and second tooling modules 28, 28′ which are mounted on the first and second ram assemblies 12, 12′. As shown in FIG. 6, each module has a mandrel 30, 30′, primary bending tools 32, 32′, and secondary bending tools 34, 34′. The mandrels 30, 30′ and the primary bending tools 32, 32′ are carried on the ends of lever arms 36, 36′. The secondary bending tools 34, 34′ are carried on the ends of levers 38, 38′.

Figure 2:
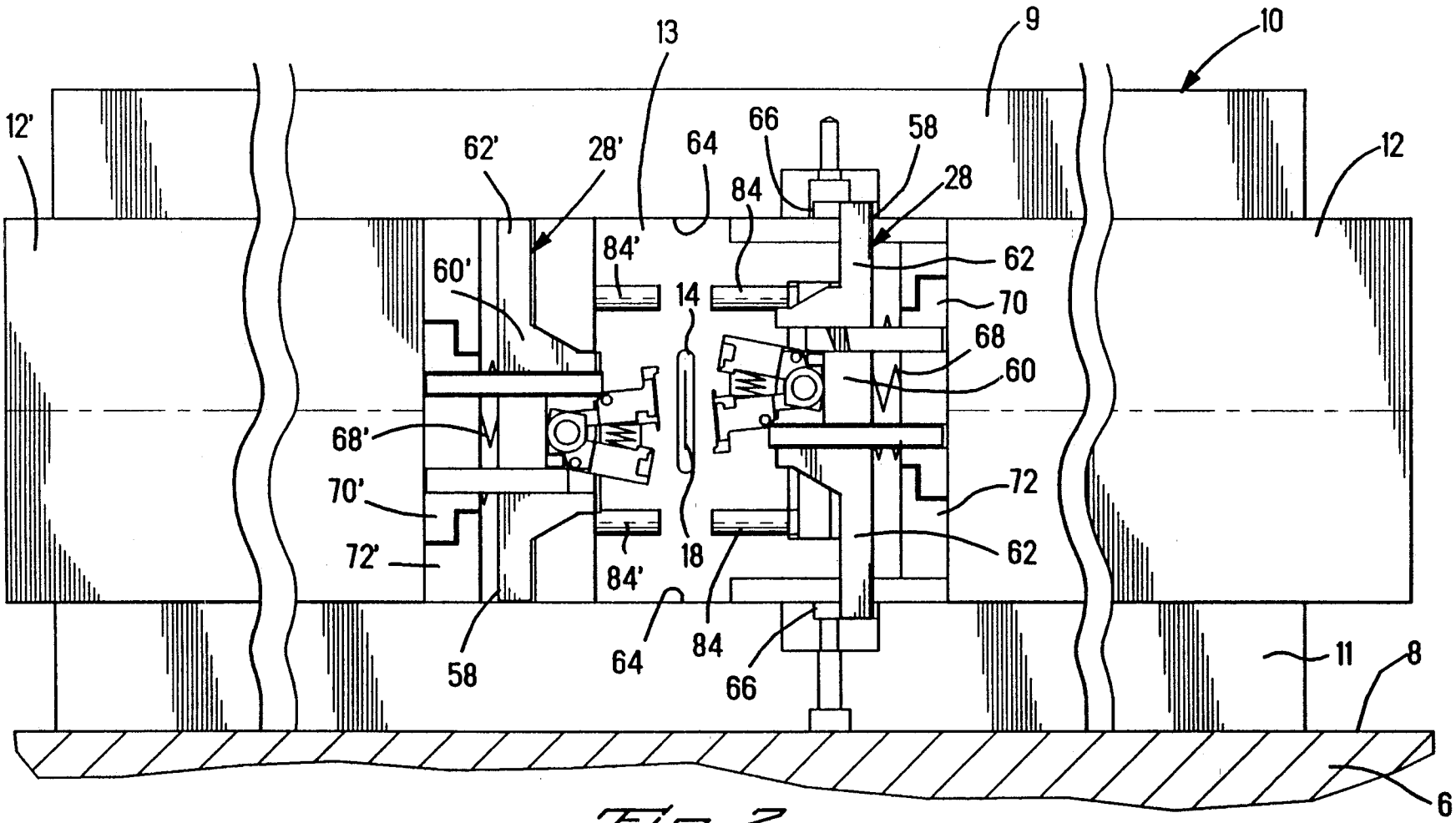
FIG. 2 is a sectional view of the ram housing showing the ram, assemblies at the beginning of an operation cycle.
Figure 3:
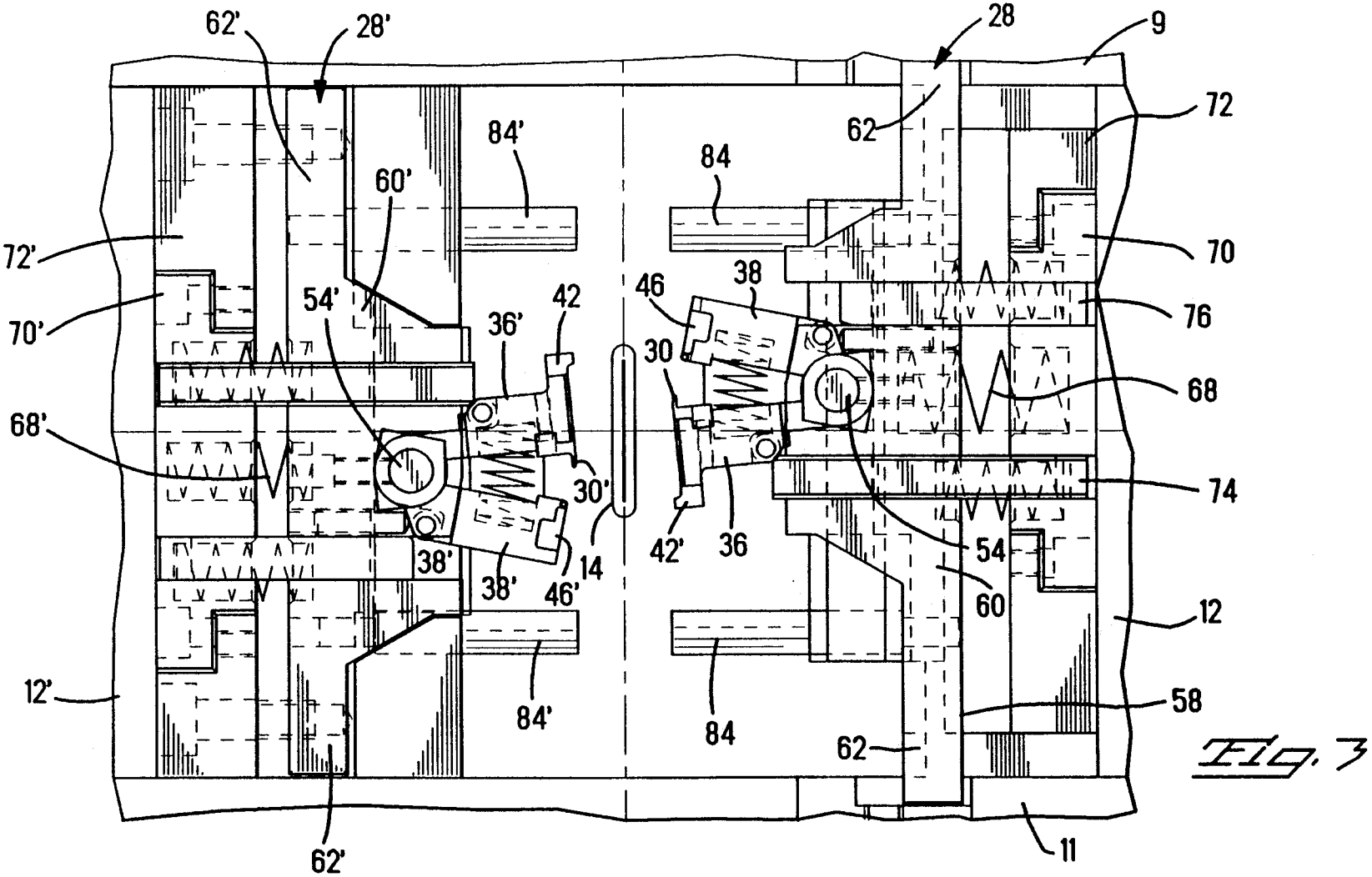
FIG. 3 is, a view on an enlarged scale of the central portion of the housing shown in FIG. 2.
Figure 4:
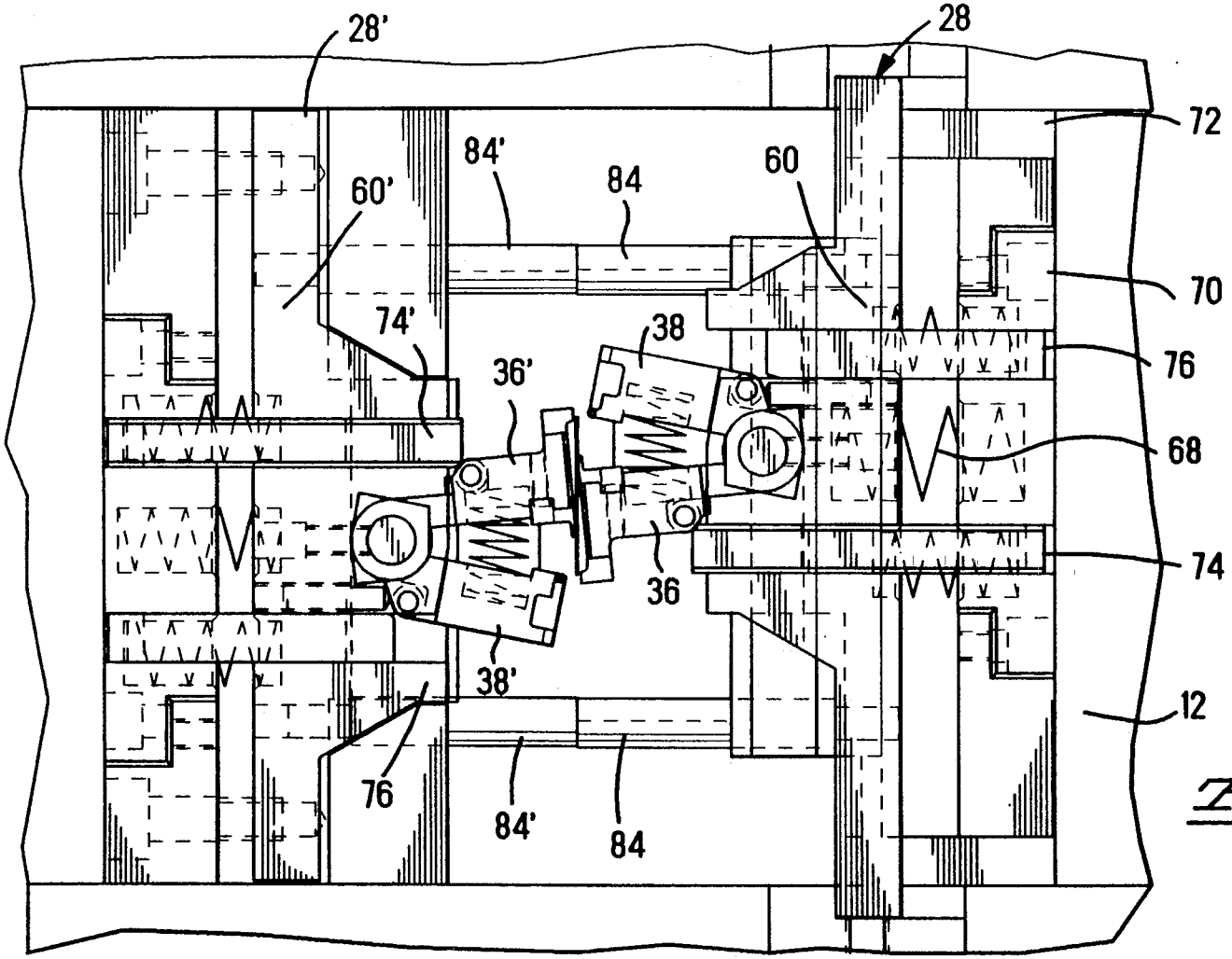
FIG. 4 is a view similar to FIG. 3 but showing the positions of the parts at an intermediate stage of the operating cycle.

At the beginning of an operating cycle, the parts will be in the positions shown in FIGS. 2 and 3 with the ram assemblies 12, 12′ and the modules 28, 28′ spaced from the strip 18. During an operating cycle, the modules and the ram assemblies move toward each other and, at an intermediate stage, occupy the positions shown in FIGS. 4–6. In these views, the mandrels 30, 30′ are substantially against the strip and the levers 36, 38, 36′, 38′ are in their open positions. The levers 36, 38 move towards each other after they arrive at the positions of FIG. 5 and the mandrels are then against the upper and lower portions of the blanks on the strip 18. Simultaneously, the primary bending tools 42, 42′ move rightwardly and leftwardly along arcuate paths so that the portions 24, 24′ are bent through an angle of 90 degrees to the positions shown in FIGS. 7, 8 and 11. Thereafter, the secondary bending tools 34, 34′ on the lever arms 38, 38′ move downwardly and upwardly respectively thereby to bend the portions 26, 26′ of the blanks around the ends of the mandrels 30, 30′ and against the side surfaces of the mandrels. After the bending operations have been completed, the lever arms 36, 36′ swing downwardly and upwardly respectively so that the mandrels are withdrawn from their positions shown in FIG. 10 in which they are between the formed over portions 26 and the central portions of the blanks. At the same time the secondary tools 34 34′ on the ends of the lever arms 38, 38′ swing to their open positions and the ram assemblies move back to their retracted positions shown in FIG. 2.

The modules 28, 28′ are similar to, but not identically, to each other and are arranged relative to each other in inverted mirror image relationship; in other words, corresponding parts such as the tooling parts described above are on opposite sides of the central axis of the ram assemblies. In the description which follows, only the module 28 and the associated structural parts of the machine are described in detail and reference will be made to the structure of the module 28′ where necessary. Corresponding parts of the two modules are identified by the same reference numerals, differentiated by prime marks.

Module 28 comprises a tool holder portion 58 and an actuator portion 70, 72. The actuator portion is fixed to the ram assembly 12. The tool holder portion is resiliently biased to the position of FIGS. 2 and 3. The tooling described above is carried on the tool holder portion and the actuator portion has camming rods thereon for actuating the tooling when the actuator is moved relatively towards the tool holder as shown in FIGS. 5–10.

Figure 5:
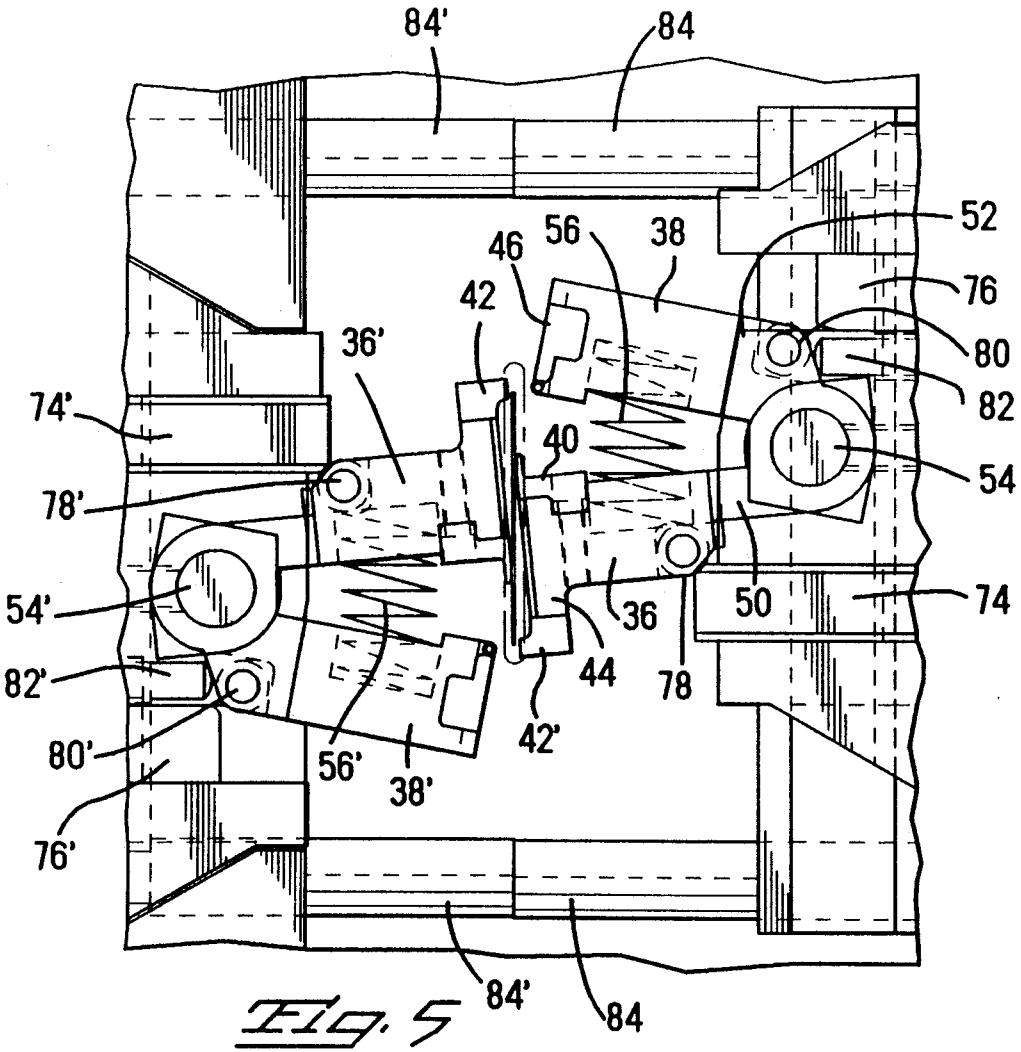
FIG. 5 is a view similar to FIG. 4 but showing the parts on an enlarged scale.
Figure 8:
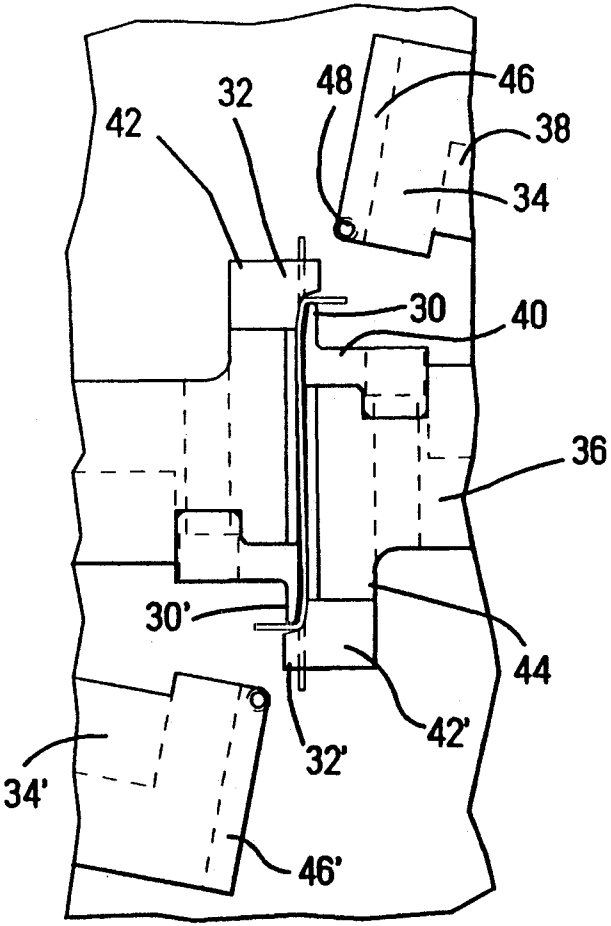
FIGS. 7 and 8 are views similar to FIGS. 5 and 6 showing the positions of the parts after the initial forming step has been carried out.
Figure 7:
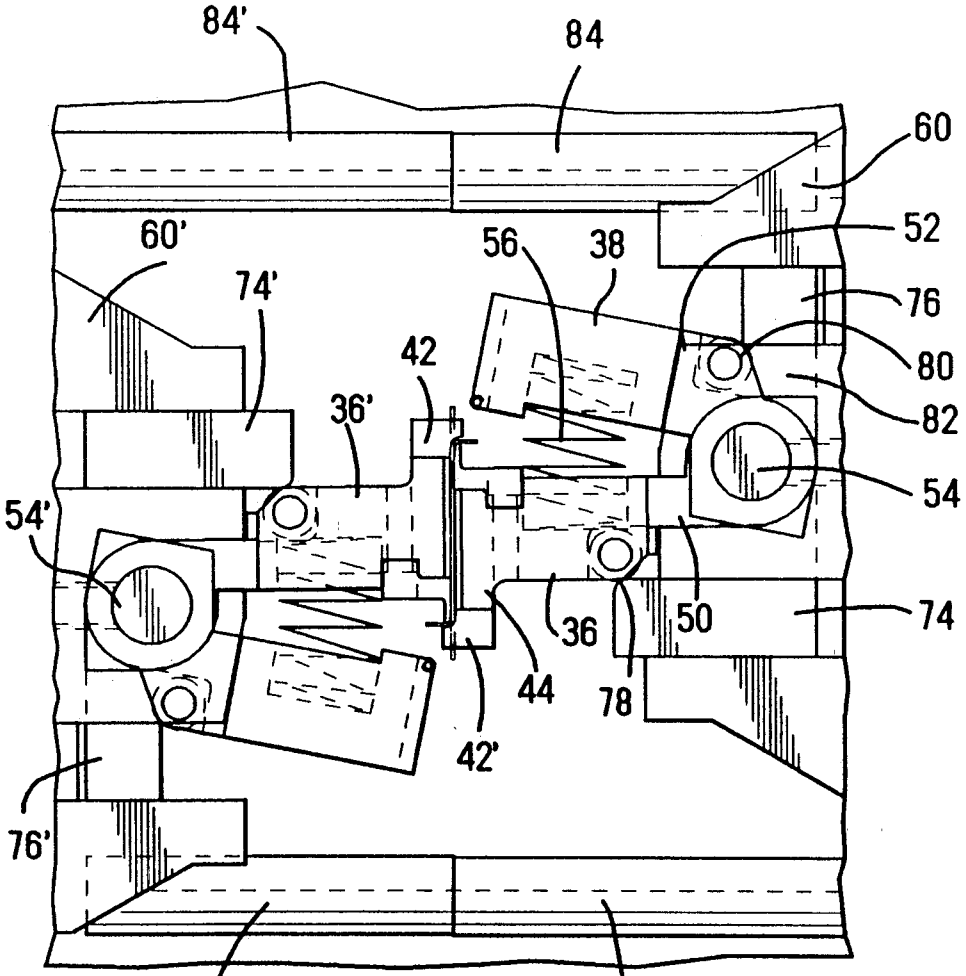
Figure 10:
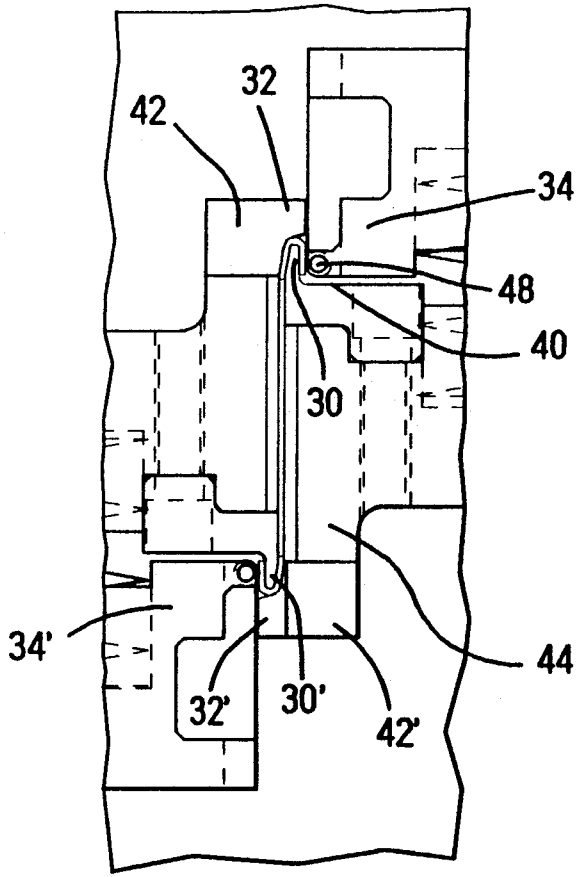
FIG. 10 is a view on an enlarged scale showing the tooling in the positions of FIG. 9.
Figure 9:
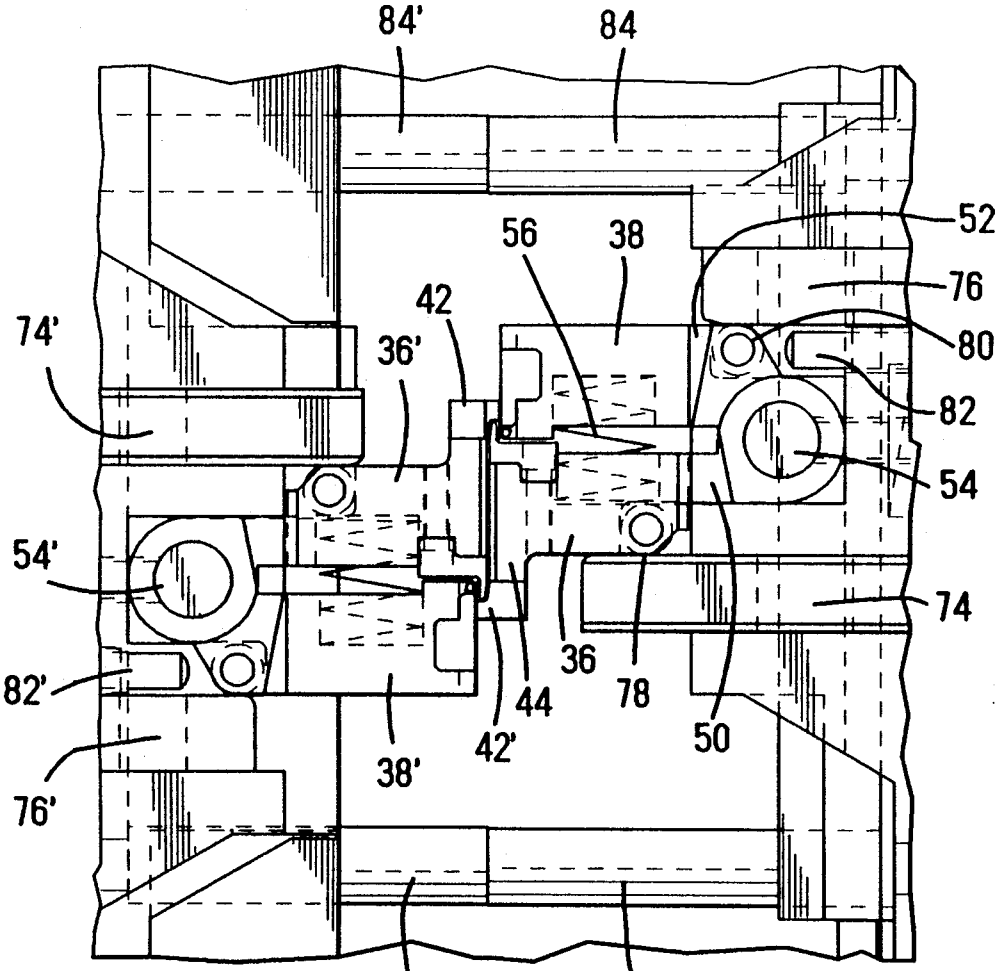
FIG. 9 is a view similar to FIG. 5 but showing the positions of the parts after the forming operations have been carried out.

The mandrel 30 is part of a mandrel insert 40, which in turn is secured to the lever arm 36. The primary bending tool 32 is manufactured as an insert 42 which is secured to the lever arm 36′. The secondary bending tool is also provided as an insert 46 on the lever arm 38. This bending tool is provided with a very small diameter roller 48 in order to avoid damage to the surface of the blank when the tool moves downwardly from the position of FIG. 8 over the surface of the blank to the position of FIG. 10. The ends 50, 52 of the lever arms 36, 38 are pivotally mounted on a common pivot pin 54 and a spring 56 is provided between these lever arms to bias them to their open positions as shown in FIG. 5.

The pivot pin 54 is supported in a movable block 58 which has a central body section 60 and arms 62 which extend laterally towards the upper and lower side walls 64 of the passageway 43 in which the ram assemblies 12, 12′ are contained. The arms 62, 62′ of the block 60 extend past these surfaces 64 and into stop inserts 66 which limit leftward movement of the module 28 from the position shown in FIG. 2 to the position shown in FIG. 4. The arms 62′ of the module 28′ bear against the internal surfaces 64 of the passageway 13.

The block 58 is resiliently biased to the position of FIG. 3 by springs 68 which are interposed between an adapter plate 70 and the block 58. The adapter plate is maintained in the position shown by a clamping plate 72 which is secured to the ram assembly 12. Camming bars 74, 76 are mounted in the adapter plate 70 and extend leftwardly as viewed in FIG. 3 and into passageways provided in the central portion 60 of the block 58. The ends of these camming bars engage rollers 78, 80 on the lever arms when the block 72 moves relatively leftwardly with respect to the block 58 thereby to swing the lever arms from their open positions to their closed positions. It is necessary to provide a stop pin 82 in the block 68 for engagement with the lever arm 38 in order to prevent it from swinging upwardly in a clockwise direction beyond the position shown in FIG. 5.

Upper and lower stop pins 84 are provided in the module 28 which engage similarly located stop pins 84′ in the module 28′ when the ram assemblies move to their forward position and the parts are in the positions of FIG. 5–10. These stop pins precisely locate the modules with respect to the strip material during the bending or forming operations.

As previously mentioned, leftward movement of the module 28 is limited by the stops 66 in the upper and lower walls 9, 11 of the housing 10. The stops 66 thus precisely limit the module 28 during the forming operations and the stops 84, 84′ precisely position the module 28′ during the forming operation. It is important that the springs 68′ which bias the module 28′ to the position shown in FIG. 3, be weaker or softer than springs 68 which bias the module 28 to the position of FIG. 3. This difference in the stiffness of the springs 68, 68′ is important for the reason that if the springs 68 are not significantly strong or stiff than the module 28′ in moving to the position of FIG. 7 might push the module 28 rightwardly a short distance from the position of FIG. 7 so that tooling would not be properly located for carrying out the forming operations. If the springs 68 extremely stiff or strong, the springs 68′ will be incapable of overcoming the springs 68 and both the modules will be precisely located during the forming operations. During the forming operations described above, the strip is maintained in position by pilot pins.

The embodiment shown has a stripper plate and tooling plates which are not important or needed for the functioning or operation of the modules 28, 28′. These plates are however needed for adjacent stations in the machine in which punching operations are carried out and extend through the portion of the die mounting area in which the modules are contained.

The embodiment of the invention described above is intended to carry out a very specific type of forming operation and the principals of the inventions can be used with different tooling for carrying out a wide variety of forming operations where moveable tools are mounted on each of the ram assemblies 12, 12'. In essence, the invention comprises a tool carrying portion which is the block 58 and an actuator portion comprising the plates 70, 72. The tool carrying portion has mounted thereon tooling which is actuated by the camming means or other actuators supported on the actuator portion.

A principal advantage of the invention is that movable tooling can be carried in one portion of each module for carrying out operations on strip material and actuated by a portion of the module which moves relative to the tooling portion. The design is extremely simple and is capable of use for a wide variety of forming operations.

We claim:

1. A machine for performing operations on strip material comprising first and second axially aligned ram assemblies which are both movable towards and away from each other along paths of reciprocation between retracted positions and forward positions strip feeding means for feeding strip material along a strip feed path which extends between the ram assemblies with the plane of the strip perpendicular to the paths of reciprocation and with said rams being both movable towards and away from said strip, the ram assemblies having leading ends which move against the strip when the ram assemblies move to their forward positions, the machine being characterized in that:

each of the ram assemblies has a forming tooling module on its leading end, the module having a tooling portion and an actuator portion, the actuator portion being fixed to the one ram assembly, the tooling portion being slidably carried by the actuator portion and being normally in a spaced position from the actuator portion, the actuator portion being relatively movable towards the tooling portion to cause actuation of said tooling portion by said sliding movement, each of the ram assemblies has forming tooling thereon that mutually cooperate for performing a forming operation on the strip material, the tooling being moved transversely of the paths of reciprocation when the forming operation is carried out, the actuator portion has actuator means thereon for moving the forming tooling when the actuator portion is moved towards the tooling portion in closer position thereto, whereby, during movement of both the ram assemblies from their retracted positions to their forward positions, the tooling portion is moved against the strip, the actuator portion is thereafter slidably moved towards the tooling portion, and the actuator means moves the forming tooling thereby to carry out the forming operation.

2. A machine as set forth in claim 1 characterized in that the forming tooling on one ram assembly is an inverted mirror image of the forming tooling on the other ram assembly.

3. A machine as set forth in claim 1 characterized in that the forming tooling comprises a bending tool which is pivotally mounted on the tooling portion, the bending tool and the actuator portion having camming means thereon for pivotally moving the bending tool when the actuator portion moves towards the tooling portion.

4. A machine as set forth in claim 1 characterized in that the tooling portion is resiliently biased to its spaced position.

5. A machine as set forth in claim 1 characterized in that the forming tooling comprises an anvil and a bending tool for bending a portion of the strip over the anvil, the anvil being movable against the strip prior to movement of the bending tool transversely of the paths of reciprocation.

6. A machine as set forth in claim 5 characterized in that the bending tool and the anvil are pivotally mounted on the tooling module.

7. A stamping and forming machine having first and second aligned opposed ram assemblies which are both movable towards and away from each other along paths of reciprocation between forward and retracted positions, strip feeding means for feeding strip material along a strip feed path which extends between the ram assemblies, the ram assemblies having tooling means thereon for performing operations on the strip material when the ram assemblies move from their retracted positions to their forward positions, the machine being characterized in that:

the first and second ram assemblies comprise first and second ram blocks having first and second tooling modules on their opposed ends, each tooling module having an actuator portion and a tool holder, the actuator portions being secured to their respective ram blocks, the tool holders being in front of the actuator portions and being resiliently biased to extended positions relative to their actuator portions so that the actuator portions can be located away from and adjacent to the tool holders, the tooling means comprises tooling on the tool holders, the tooling on each tool holder being movable relative to its associated tool holder when the operations on the strip material are performed, tool holder stop means are provided for stopping movement of the tool holders at a location adjacent to the strip material when the ram assemblies move to their forward positions, and the actuator portions have actuator means which engage the tool holders during the final stages of movement of the ram assemblies to their forward positions for causing movement of the tooling relative to the tool holder thereby to perform the operations on the strip material whereby, the tool holders will be in their extended positions when the ram assemblies are in their retracted positions, and when the ram assemblies move to their forward positions the tool holders will be stopped when the tool holders engage the tool holder stop means, the actuator portions will then be moved to locations adjacent to the tool holders, and the actuator means will cause movement of the tooling whereby the operations will be performed on the strip material.

8. A machine as set forth in claim 7 characterized in that the tool holder stop means comprises at least one fixed stop which is located on the path of reciprocation of the first ram assembly adjacent to the strip feed path.

9. A machine as set forth in claim 7 characterized in that the tool holder stop means comprises stops on the tool holders which are against each other when the tool holders are adjacent to the strip material.

10. A machine as set forth in claim 7 characterized in that the stop means comprises a fixed stop which is on the path of reciprocation of the first ram assembly adjacent to the strip feed path and stops on the tool holders which are against each other when the tool holders are adjacent to the strip feed path.

11. A machine as set forth in claim 10 characterized in that the tool holder on the first ram assembly is a first tool holder, the tool holder on the second ram assembly is a second tool holder, the first and second tool holders are resiliently biased to their extended positions by first and second springs, the first spring being more stiff than the second spring whereby the second tool holder is not capable of pushing the first tool holder away from the fixed stop.

12. A machine as set forth in claim 7 characterized in that the tooling on at least one of the tool holders comprises forming tools on the ends of arms, the arms being pivotally mounted on the one tool holder.

13. A machine as set forth in claim 12 characterized in that the arms are mounted on a common pivotal axis and the actuator means comprises camming means on the actuator portion.

14. A machine as set forth in claim 7 characterized in that the tooling on each of the tool holders comprises a pair of forming tools on the ends of arms, the arms being pivotally mounted on the tool holder.

15. A machine as set forth in claim 14 characterized in that the arms are mounted on a common pivotal axis, the arms are resiliently biased to an open position, and the actuator means comprises camming means on the actuator portion for moving the arms to a closed position.

16. A machine as set forth in claim 7 characterized in that the first and second tooling modules are inverted mirror images of each other.

17. A machine as set forth in claim 15 characterized in that the first and second tooling modules are inverted images of each other.

18. A machine as set forth in either of claims 7 or 11 characterized in that the actuator means comprises camming means.

19. A machine as set forth in claim 18 characterized in that the camming means comprises camming rods which are moved into engagement with the tooling.

* * * * *